United States Patent [19]

Scheidl

[11] 3,941,188

[45] Mar. 2, 1976

[54] TUBE SPACER GRID FOR A HEAT-EXCHANGER TUBE BUNDLE

[75] Inventor: Helmut Scheidl, Erlangen, Germany

[73] Assignee: Siemens Aktiengesellschaft, Munich, Germany

[22] Filed: Mar. 13, 1974

[21] Appl. No.: 450,880

[30] Foreign Application Priority Data

Mar. 30, 1973 Germany ..... 2316133

[52] U.S. Cl. ..... 165/162; 122/510

[51] Int. Cl.[2] ..... F28F 9/00

[58] Field of Search ..... 122/32, 510; 165/162

[56] References Cited

UNITED STATES PATENTS

| | | | |
|---|---|---|---|
| 2,198,529 | 4/1940 | Fields | 165/162 X |
| 3,212,570 | 10/1965 | Holman | 165/162 |
| 3,399,719 | 9/1968 | Forrest et al. | 165/162 X |
| 3,420,297 | 1/1969 | Romanus | 165/162 |
| 3,575,236 | 4/1971 | Romanus | 165/162 |

*Primary Examiner*—Charles J. Myhre
*Assistant Examiner*—Theophil W. Streule, Jr.
*Attorney, Agent, or Firm*—Kenyon & Kenyon Reilly Carr & Chapin

[57] ABSTRACT

A tube spacer grid for a heat-exchanger tube bundle is formed by an annular grid frame having a groove formed in its inner surface in which the interspaced grid bars have their ends positioned and held in interspaced relationship by short sections of tubes passed through holes axially formed in the grid frame so that the tubes are positioned between the ends of the grid bars in the grooves. The tube sections may be cut from the same tubes used to form the tube bundle.

5 Claims, 3 Drawing Figures

TUBE SPACER GRID FOR A HEAT-EXCHANGER TUBE BUNDLE

BACKGROUND OF THE INVENTION

A pressurized-water reactor's steam generator's heat-exchanger tube bundle must operate under the stress of high-velocity flow of the reactor pressurized-water coolant which is passed through the tube bundle, and under the stress involved by the flow of steam-generating feed water upwardly through the tube bundle outside of its tubes.

An example of a prior art steam generator, such as is currently used in the main coolant loop of a pressurized-water reactor, is provided by the Green U.S. Pat. No. 3,483,848, dated Dec. 16, 1969. This reference to this patent hereby incorporates its disclosure into the present specification.

As shown by the above patent, such a steam generator has a heat-exchanger formed by an inverted U-tube bundle formed by a large number of individual U-shaped tubes, the tube bundle being vertical with its tube ends mounted in a horizontal tube sheet through which the reactor coolant is passed via appropriate intake and outlet manifolds connected to the main coolant loop of the reactor. Flow velocities, temperatures and fluid pressures are all of a high order. The individual tubes of the tube bundle, particularly throughout their vertical leg portions, must be kept separated from each other by uniformly distributed interspacing.

To keep the individual tubes of such a heat-exchanger properly interspaced, the vertical legs are held by the grid bars of a tube spacer grid, this being formed by an annular grid frame for attachment to the inside of the steam generator's casing, and mounting appropriately interspaced, criss-crossed grid bars, forming a latticework having appropriately spaced openings through which the individual heat-exchanger tubes are arranged.

Heretofore, the grid bars have been welded directly to the grid frame. Thermal expansion and contraction of the grid bars has caused them to warp out of shape when in service. The welding operation required for the connection of the grid bar ends to the grid frame has sometimes caused local deformations. The application of such prior art spacer grids to the tube bundle legs has been troublesome and time consuming.

SUMMARY OF THE INVENTION

The above disadvantages are avoided by the present invention.

According to this invention, the grid frame is an annular form that is generally rectangular in cross section and represents what is in effect a cylindrical section of very short length. Two grooves are machined into the inside surface of this grid frame, the grooves being annular, interspaced from each other axially with respect to the annular frame and having a rectangular contour defining in each instance upper and lower flanges. The grid bars, appropriately lengthened to follow the annular or cylindrical contour of the grid frame, have their end portions inserted in these grooves by appropriate angular and horizontal shifting motions of the grid bars, to form two vertically interspaced layers of grid bars with those of one layer being criss-crossed with respect to those of the other to design a latticework in the meshes of which the heat-exchanger tubes may be positioned.

Now, instead of welding the ends of these grid bars to the grid frame to keep the grid bars permanently positioned, the grid frame is formed with axially extending holes aligned with the interspaces between the grid bar ends required for the interspacing of the grid bars. As to the uppermost groove, these holes are formed as an annular series which extend axially with respect to the grid frame and which extend through both of the flanges formed by the upper one of the annular grooves. For the lowermost one of the annular grooves, the holes are formed upwardly through the grid bar frame, axially with respect to the latter, so as to pass through both flanges formed by the lowermost groove. Thus, these holes are formed through the top and bottom ends of the grid frame and have open ends which respectively open through the top and bottom ends of the grid frame.

Short tubular sections are passed through these holes to effect the necessary interspacing of the grid bar ends. One of the tube sections is passed through the holes between each two of the grid bar ends. These tube sections may be cut from the same tube stock used to make the heat-exchanger tube bundle, this assuring that the spacer grid meshes substantially exactly fit the tubes of the heat-exchanger tube bundle legs, the interspacing of the heat-exchanger tubes being established by the horizontal widths of the grid bars used, these widths, in turn, being chosen to provide the desired interspacing of the heat-exchanger tubes.

With the short tube sections inserted in each of the holes of the grid frame, downwardly in the case of the upper grooves and upwardly in the case of the lower grooves, the tube ends exposed at the respective ends of the grid frame are then fastened to these ends by welding. Thus, only the short tube sections are welded; the grid bars are not themselves welded to the grid frame. Localized overheating of the working parts of the spacer grid is, in this way, completely avoided.

Furthermore, the grid bars are lengthened so that the ends have at least slight endwise freedom from the grooved bottoms formed by the grid frame grooves in which the grid bar ends are inserted. This leaves each complete bar individually free to longitudinally expand and contract without any warping tendency, its length being, of course, chosen so that its ends have adequate freedom to ride back and forth horizontally in the grid frame grooves to the extent required to prevent longitudinal stressing of the grid bars when they thermally expand and contract longitudinally. It is to be understood that the grid bar ends are not welded to either their interspacing short tube sections or to the grid frame. The grid bar end spaces are restricted to the extent required to assure the grid bar ends being always retained in the grid frame grooves, although free to move therein longitudinally with respect to the bars. The interspacing short tube sections do not provide any substantial frictional restraint to the grid bar end movements resulting from grid bar thermal expansion and contraction.

BRIEF DESCRIPTION OF THE DRAWINGS

The presently preferred mode of carrying out the invention is illustrated by the accompanying drawings in which.

DETAILED DESCRIPTION OF THE INVENTION

Figure 1:
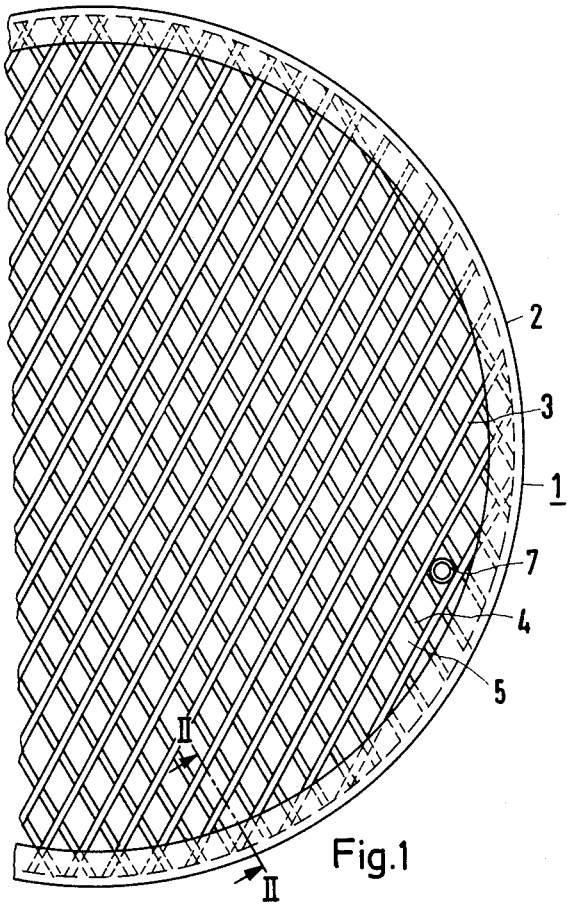
FIG. 1 is a plan view showing approximately half of the grid spacer, it being understood that the spacer has a circular contour as required to fit the inside of the steam generator casing or housing which is itself cylindrical.
Figure 2:
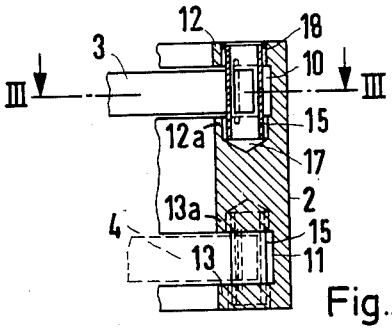
FIG. 2 is a vertical section taken on the line 2—2 in FIG. 1.

Referring to the above drawings, the spacer grid 1 is shown as having the cylindrical solid metal grid frame 2 of relatively short axial length, as can be appreciated from FIG. 2, the upper level of grid bars being shown at 3 and the lower level at 4. The mesh openings are indicated at 5 and one of the heat-exchanger tube bundle, leg tubes is shown at 7 in one of the mesh openings 5 and firmly embraced by the criss-crossed grid bars 3 and 4.

Figure 3:
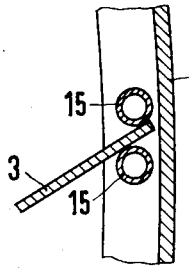
FIG. 3 is a cross section taken on the line 3—3 in FIG. 2

In FIG. 2 the rectangular cross section of the grid frame 2 can be seen particularly well, together with the upper and lower annular grooves 10 and 11, respectively, machined, as by milling, into the inside surface of the grid bar frame 2. The heights of these grooves are made only very slightly greater than the heights of the grid bars 3 and 4, keeping in mind that these grid bar ends must slide back and forth in these grooves. The grooves themselves are of generally rectangular cross section, the upper groove by its nature forming an upper flange 12 and a lower flange 12*a*, the lower groove forming corresponding flanges 13 and 13*a*. The described arrangement positively prevents the grid bar ends from unrestricted up and down motion. The short tube sections, cut from the same tube stock, from which the heat exchanger tubes are cut, are shown particularly well by FIG. 3, performing their function of holding the grid bar ends properly interspaced and against horizontal displacement or circumferentially with respect to the grid frame 2. These tube sections 15 are shown inserted into the holes 17 respectively drilled in the opposite ends, or top and bottom ends of the grid frame 2, the holes being open at the ends of the frame and in each instance intersecting both of the flanges of the respective grooves. These tube sections 15 are retained in place by the welding shown at 18. The application of this welding metal is relatively remote from the grid bar ends and from the stressed portions of the grid frame and of the interspacing tubes 15, it being only the outer ends of the latter that are heated by the welding.

In connection with the previous reference to the heat-exchanger tube interspacing being established by the horizontal width of the grid bars, it should be kept in mind that this width must be calculated with respect to the geometry involved by the criss-crossing arrangement of the grid bars. For example, when the criss crossing is diagonal, or at an angle other than 90° the geometry as well as the bar width must be taken into consideration when calculating the design required to fit the tube pitch of the heat-exchanger tube bundle.

It is to be understood that more than one of such spacer grids may be required for one heat-exchanger tube bundle of the type described.

If not previously specifically noted, it is to be understood that all of the parts of the grid spacer are made of metal suitable for use in a steam generator where the spacer grids are exposed to the secondary medium, or steam generator feed water, although not to the primary medium which is the pressurized-water coolant of the reactor.

What is claimed is:

1. A spacer grid for holding the interspaced individual tubes of a pressurized-water reactor's steam generator's heat-exchanger tube bundle, comprising an annular grid frame having an inner surface in which an annular groove is formed, a series of mutually interspaced grid bars each having opposite end portions which are interspaced and inserted in said groove, said frame having ends and having axially extending interspaced holes formed through at least one of said ends and through said groove, said holes being formed between said end portions, and cylindrical sections inserted through said holes and holding said end portions interspaced in said groove.

2. The grid of claim 1 in which said sections are tubular.

3. The grid of claim 2 in which at least one heat-exchanger tube is passed between said bars and within said grid frame, and said sections are short sections of the same diameter and material as said tube.

4. The grid of claim 2 in which said sections are welded to said frame.

5. The grid of claim 3 in which said frame has a second annular groove formed in the frame's said inner surface and the other of said ends has axially extending interspaced holes formed through this other end and through said second groove, and has a second series of mutually interspaced grid bars each having opposite end portions which are interspaced and inserted in said second groove, said holes formed through said other end being formed between said end portions of said second series of grid bars, and short sections of the same diameter and material as said tube being inserted in said holes formed through said other end, said two series of grid bars being arranged in mutually criss-crossed relationship.

* * * * *